US009176403B2

(12) United States Patent
Moffat et al.

(10) Patent No.: US 9,176,403 B2
(45) Date of Patent: Nov. 3, 2015

(54) PROCESS FOR PREPARING LATEX COMPRISING CHARGE CONTROL AGENT

(71) Applicant: XEROX CORPORATION, Norwalk, CT (US)

(72) Inventors: Karen Moffat, Brantford (CA); Shigang Steven Qiu, Toronto (CA); Samir Kumar, Pittsford, NY (US); Robert D. Bayley, Fairport, NY (US); Grazyna E. Kmiecik-Lawrynowicz, Fairport, NY (US); Maura A. Sweeney, Irondequoit, NY (US)

(73) Assignee: XEROX CORPORATION, Norwalk, CT (US)

( * ) Notice: Subject to any disclaimer, the term of this patent is extended or adjusted under 35 U.S.C. 154(b) by 121 days.

(21) Appl. No.: 13/943,720

(22) Filed: Jul. 16, 2013

(65) Prior Publication Data

US 2015/0024323 A1 Jan. 22, 2015

(51) Int. Cl.

| | |
|---|---|
| ***G03G 9/093*** | (2006.01) |
| ***G03G 9/08*** | (2006.01) |
| ***G03G 9/097*** | (2006.01) |
| ***G03G 9/087*** | (2006.01) |

(52) U.S. Cl.

CPC ..... *G03G 9/0806* (2013.01); *G03G 9/0823* (2013.01); *G03G 9/08708* (2013.01); *G03G 9/08728* (2013.01); *G03G 9/08731* (2013.01); *G03G 9/09321* (2013.01); *G03G 9/09335* (2013.01); *G03G 9/09392* (2013.01); *G03G 9/09783* (2013.01); *G03G 9/09791* (2013.01)

(58) Field of Classification Search

CPC ..... G03G 9/0806; G03G 9/09335; G03G 9/09321; G03G 9/09392; G03G 9/0804; G03G 9/0823; G03G 9/09783

USPC ..... 430/137.17, 110.2, 137.14

See application file for complete search history.

(56) References Cited

U.S. PATENT DOCUMENTS

| | | | |
|---|---|---|---|
| 2,874,063 | A | 3/1953 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,983,045 | A | 9/1976 | Jugle et al. |
| 4,265,990 | A | 5/1981 | Stolka et al. |
| 4,299,903 | A | 11/1981 | AuClair et al. |
| 4,563,408 | A | 1/1986 | Lin et al. |
| 4,584,253 | A | 4/1986 | Lin et al. |
| 4,935,326 | A | 6/1990 | Creatura et al. |
| 4,937,166 | A | 6/1990 | Creatura et al. |
| 4,950,575 | A | 8/1990 | Shiozaki et al. |
| 5,223,368 | A | 6/1993 | Ciccarelli et al. |
| 5,227,460 | A | 7/1993 | Mahabadi et al. |
| 5,324,613 | A | 6/1994 | Ciccarelli et al. |
| 5,346,797 | A | 9/1994 | Krniecik-Lawrynowicz et al. |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,004,714 | A | 12/1999 | Ciccarelli et al. |
| 6,165,668 | A | 12/2000 | Wilson et al. |
| 6,190,815 | B1 | 2/2001 | Ciccarelli et al. |
| 6,221,550 | B1 | 4/2001 | Wilson et al. |
| 6,652,634 | B1 | 11/2003 | Akers, Jr. et al. |
| 7,141,345 | B2 * | 11/2006 | Yamasaki et al. ..... 430/110.2 |
| 7,435,521 | B2 | 10/2008 | Yagi et al. |
| 7,781,135 | B2 | 8/2010 | Asarese et al. |
| 2003/0191263 | A1 | 10/2003 | Yoshida et al. |
| 2004/0002014 | A1 | 1/2004 | Chae et al. |
| 2004/0248025 | A1 | 12/2004 | Miyakawa |
| 2007/0281232 | A1 | 12/2007 | Yoshimura |
| 2009/0130582 | A1 | 5/2009 | Handa et al. |
| 2009/0136863 | A1 | 5/2009 | Asarese et al. |
| 2009/0202931 | A1 | 8/2009 | Lincoln et al. |
| 2010/0203440 | A1 * | 8/2010 | Kunii et al. ..... 430/108.23 |
| 2012/0328976 | A1 * | 12/2012 | Seki et al. ..... 430/105 |

FOREIGN PATENT DOCUMENTS

| | | | |
|---|---|---|---|
| EP | 1 236 755 | A2 | 9/2002 |
| EP | 1 383 011 | A1 | 1/2004 |
| EP | 1 426 830 | A1 | 6/2004 |

OTHER PUBLICATIONS

American Chemical Society (ACS) File Registry No. 16283-36-6 on STN, copyright 2015, which was entered in STN Nov. 16, 1984.*

German Patent Office Communication dated Feb. 24, 2012, for German Patent Application No. 102010041846.3 (5 pages)

Canadian Patent Office Communication dated Jan. 16, 2013, for Canadian Patent Application No. 2716666 (2 pages).

* cited by examiner

*Primary Examiner* — Janis L Dote

(74) *Attorney, Agent, or Firm* — Pillsbury Winthrop Shaw Pittman LLP

(57) ABSTRACT

A process includes forming, by emulsion polymerization, polymer resin particles in a latex, the polymer resin particles being formed from a mixture including one or more monomer emulsions and a non-surfactant-based charge control agent, the emulsion polymerization is carried out with a solids content in a range from about 10 to about 30 percent by weight of the mixture, and forming toner particles from the polymer resin particles, the toner particles support a sufficient triboelectric charge for use under A-zone environmental conditions in a single-component development system.

17 Claims, 4 Drawing Sheets

PROCESS FOR PREPARING LATEX COMPRISING CHARGE CONTROL AGENT

FIELD

Embodiments disclosed herein relate to latexes used in the manufacture of toner particles. More particularly, embodiments disclosed herein relate to processes for the preparation of latexes comprising charge control agents suitable for preparing toner particles for use in single-component development systems.

BACKGROUND

Toner systems employed in connection with an imaging apparatus typically fall into two classes: (1) two-component development (TCD) systems, in which the developer materials include magnetic carrier granules and toner particles designed to triboelectrically adhere to the carrier; and (2) single-component development (SCD) systems, which rely on toner particles without the presence of a carrier which are charged relative to a charging blade.

The charging requirements for toners in SCD systems are very different from those employed in TCD systems. A particular challenge in SCD systems is achieving adequate charging under high temperature and high humidity environments, such as those designated as "A-zone," about 28° C./85% relative humidity. In order to achieve sufficient triboelectric charge, a charge control agent (CCA) is typically associated with the toner particle.

One means to add a CCA to toner particles is by dry blending the CCA as a surface additive. By way of example, a CCA may be dry blended onto styrene/acrylate emulsion aggregation (EA) toner particles. In use, it has been observed that such surface-modified EA toner particles suffer from drop-off in density after about 10,000 prints.

A second option to associate a CCA with toner particles is to add the CCA at the polymer synthesis stage. For example, in an EA system such as that described above, the CCA may be added to an emulsion of monomers and an emulsion polymerization carried out. The resultant product comprises EA toner particles with CCA incorporated into the polymer matrix. In general, such CCA-doped EA toner particles may perform better than their dry-blended surface-modified counterparts. However, the process for performing the emulsion polymerization in the presence of a CCA is not always reproducible and/or scale up is not always readily achieved. In numerous instances, problems may arise with reactor fouling.

SUMMARY

In some aspects, embodiments disclosed herein relate to a process comprising forming, by emulsion polymerization, polymer resin particles in a latex, the polymer resin particles being formed from a mixture comprising one or more monomer emulsions and a non-surfactant-based charge control agent, wherein the emulsion polymerization is carried out with a solids content in a range from about 10 to about 30 percent by weight of the mixture; and forming toner particles from the polymer resin particles, wherein the toner particles support a sufficient triboelectric charge for use under A-zone environmental conditions in a single-component development system.

A process comprising forming, by emulsion polymerization, a latex from a mixture comprising a monomer emulsion comprising acrylate and styrene monomers in water, and about 0.1 percent to about 10 percent by weight of the mixture of a metal salicylate wherein the solids content of the mixture is in a range from about 10 to about 30 percent by weight of the mixture.

DETAILED DESCRIPTION

Figure 1A:
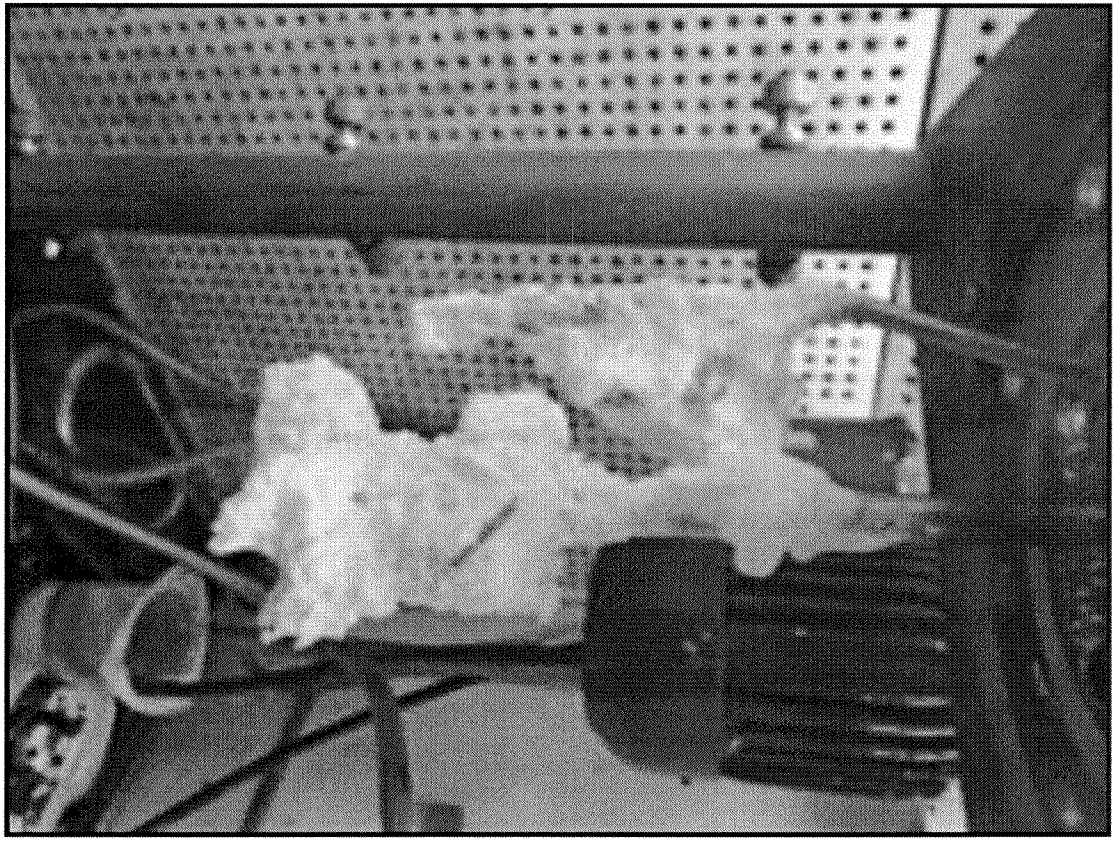
FIGS. 1A-D show photographs of reactor fouling around the impeller (1A) and walls of the reactor (1B) from Example 4 in comparison to the results of lower solids content with minimal reactor fouling of the impeller (1C) and walls of the reactor (1D) from Example 8.
Figure 1B:
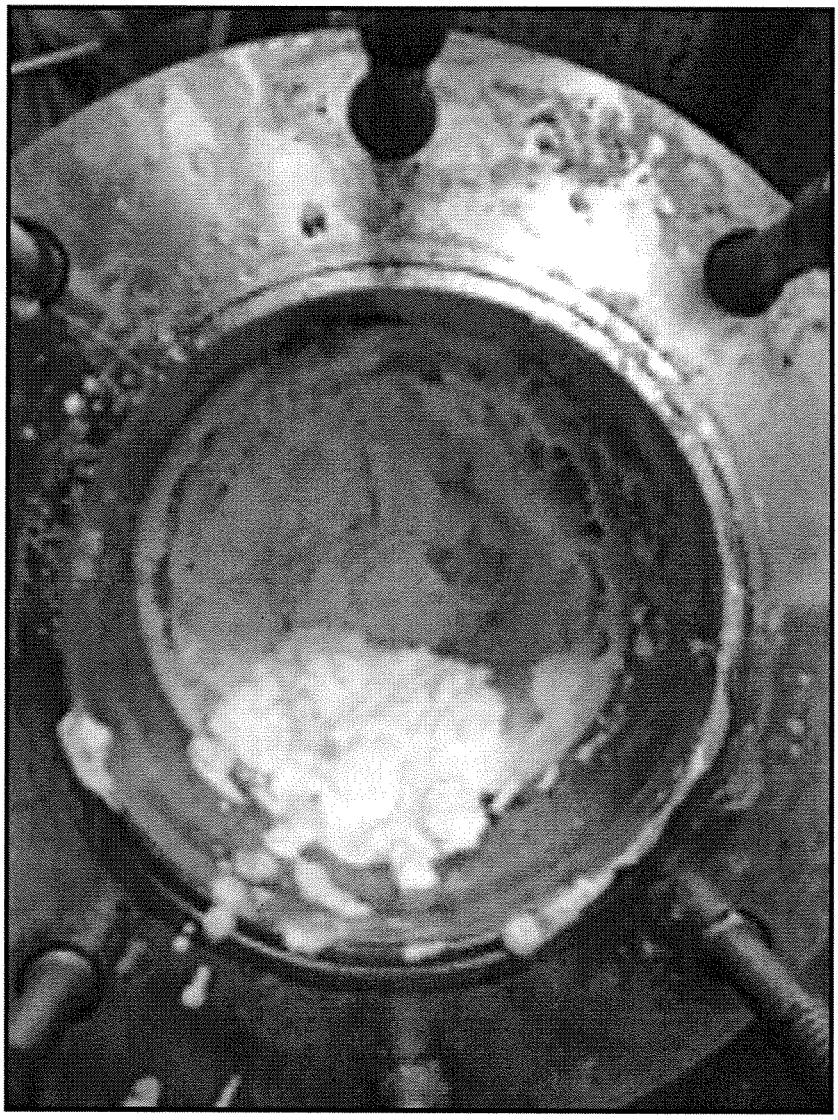
Figure 1C:
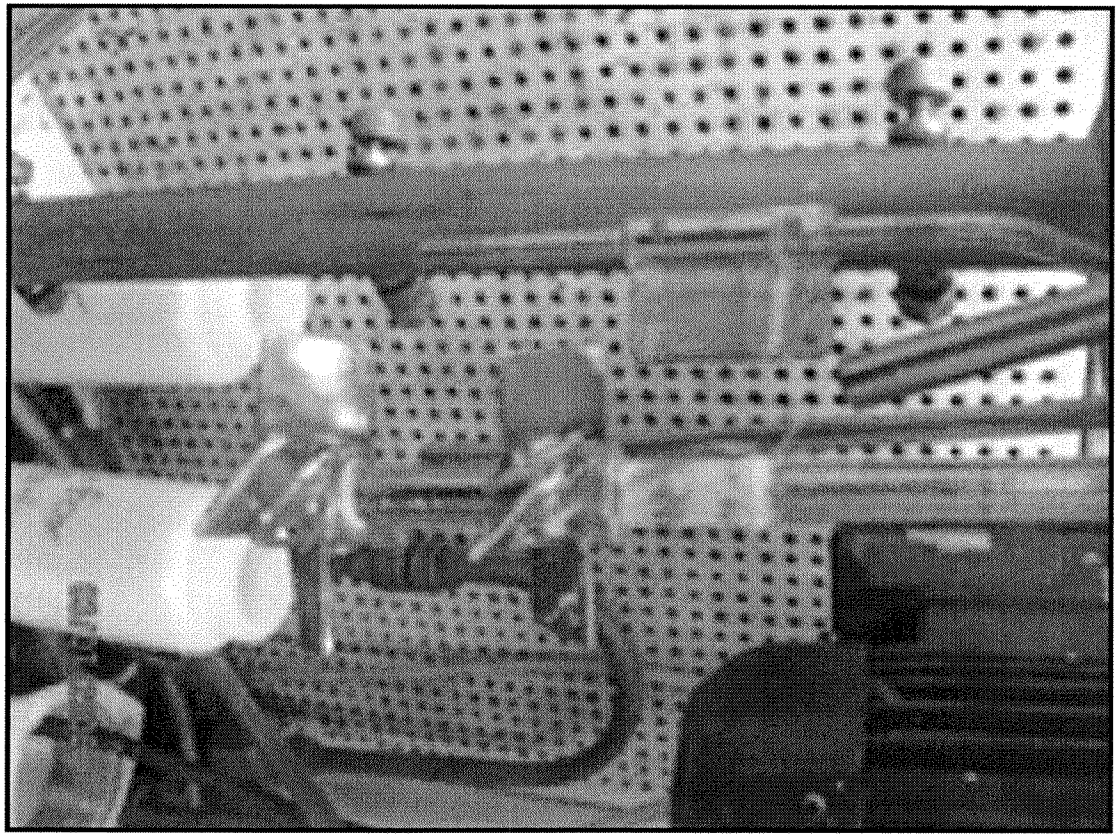
Figure 1D:
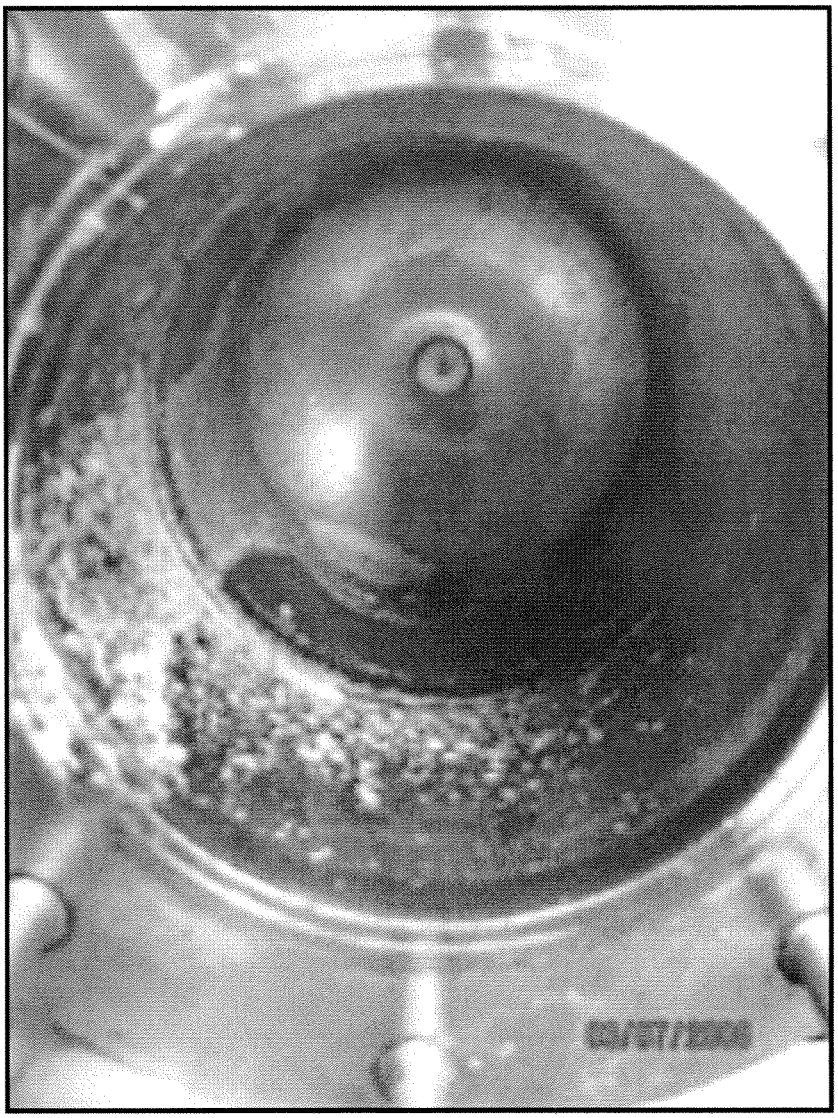

Embodiments disclosed herein relate to processes for producing latexes by starve-fed emulsion polymerization in the presence of a charge control agent, whereby the processes occur with a minimal amount of reactor fouling while being amenable to reproducible scale-up. In some aspects, reduced reactor fouling may be achieved by lowering the solids content during the emulsion polymerization to form the latex. In some aspects, reduced reactor fouling may be enhanced at low charge control agent concentrations. In other aspects, reduced reactor fouling may be enhanced by a combination of low solids content during emulsion polymerization and low charge control agent concentrations. Reduction in reactor fouling may provide overall improved latex yields and thereby reduce costs associated with toner particle production.

Furthermore, processes disclosed herein may employ a non-surfactant-based charge control agent (CCA) at the emulsion polymerization stage to incorporate the CCA within the polymer matrix of the polymer resin particles of the resultant latex. Toner particles made from such latexes may exhibit good performance under A-zone environmental conditions. In embodiments, charge control agents having low hygroscopicity may be particularly useful for this purpose.

The processes disclosed herein may provide the above benefits, while maintaining control of the latex particle size with minimal settling of coarse particles for subsequent use in emulsion aggregation processing to form toner particles. Furthermore, the initial latexes formed by processes disclosed herein may be used to strategically place CCA-doped latex in the core, shell, or both in toner particles having core-shell configurations. Other advantages and benefits of the processes disclosed herein will be apparent to those skilled in the art.

Embodiments disclosed herein provide processes comprising forming polymer resin particles of a latex by starve-fed emulsion polymerization, the polymer resin particles being formed from a mixture comprising one or more monomer emulsions and a non-surfactant based charge control agent, wherein starve-fed emulsion polymerization is carried out with a total solids content in a range from about 10 to about 30 percent by weight of the mixture, and the processes further comprising forming toner particles from the polymer resin particles, the toner particles supporting a sufficient triboelectric charge for use under A-zone environmental conditions in a single-component development system.

As used herein, "latex" generally refers to a liquid having polymeric resin particles dispersed therein. Latexes may be prepared directly from emulsion polymerization reactions.

As used herein, "non-surfactant-based charge control agent" refers to any charge control agent that would not be classified as a surfactant. Surfactant-based CCAs include, without limitation, quaternary ammonium surfactants, such as stearyl dimethyl benzyl ammonium para-toluene sulfonate, stearyl dimethyl phenethyl ammonium para-toluene sulfonate, cetyl pyridinium chloride, distearyl dimethyl ammonium methyl sulfate, benzyldimethyloctadecylammonium chloride, DDABS and the like. Non-surfactant-based charge control agents include metal salicylates, such as 3,5-di-tert-butylsalicylic acid zirconium salt, 3,5-di-tert-butylsalicylic acid calcium salt, 3,5-di-tert-butylsalicylic acid zinc salt, 3,5-di-tert-butylsalicylic acid aluminum salt, 3,5-di-tert-butylsalicylic acid iron salt, 3,5-di-tert-butylsalicylic acid chromium salt and the like. In some embodiments, the charge control agents employed in processes disclosed herein may be surfactant-based, with the proviso that the surfactants exhibit a sufficiently low hydrophilicity.

As used herein, "A-zone environmental conditions" refers to high temperature/high humidity conditions employed when screening charge performance efficacy of toner particles disclosed herein. A-zone includes high humidity, such as about 85% relative humidity at a temperature of about 28° C. Toner particles disclosed herein may perform well under such A-zone conditions. Similarly, the toner particles disclosed herein may also perform well under C-zone conditions, that is, low humidity such as about 15% relative humidity at a temperature of about 10° C.

As used herein, "single-component development system" refers to the use of toner particles in a toner composition that operate in the absence of carrier particles.

As used herein, "emulsion polymerization" generally refers to a radical polymerization that is carried out in an emulsion incorporating water, monomers, and usually a surfactant. An emulsion polymerization is "starved-fed" when the monomers are fed at a sufficiently slow rate to cause them to be a limiting reagent in the polymerization. Thus, one or more monomers may be introduced gradually into the reaction vessel at a rate that allows the majority of one or monomers to be consumed in the reaction before more reagents are added. One skilled in the art will appreciate that such conditions may allow control of the distribution of different monomers in a copolymer, providing access to different copolymer types such as block copolymers, random copolymers, periodic polymers, and the like.

As used herein, "solids content" generally refers to the non-aqueous portion of the emulsion polymerization reaction mixture. Thus, the beneficial use of lower solids content in accordance with embodiments disclosed herein means a larger fraction of water makes up the emulsion polymerization reaction mixture. For example, in some embodiments about 25 percent solids content may substantially reduce reactor fouling. In such an emulsion polymerization, water makes up the balance, i.e. about 75 percent, of the remaining reaction mixture.

In embodiments, the step of forming the polymer resin particles as part of a latex generates less than about 10 percent reactor fouling, as measured by the weight loss. Less than 10 percent reactor fouling has been demonstrated at solids contents of around less than about 30 percent by weight of the polymerization reaction mixture, i.e. about 70 percent by weight water. In embodiments, emulsion polymerization processes disclosed herein incorporating charge control agent at low solids content may reduce reactor fouling by about 50 to about 99 percent. In embodiments, processes disclosed herein may be accompanied by less than about 10 percent, or less than about 5 percent, or less than about 2 percent reactor fouling. In embodiments, the solids content may be in a range from about 10 to about 30 percent, or about 12 to about 25 percent, or about 15 to about 20 percent by weight of the polymerization reaction mixture in order to achieve reduced reactor fouling. In embodiments, reactor fouling can also be ameliorated with reduced CCA loadings, such as less than about 3, 2, or 1 percent CCA loading. In embodiments, the non-surfactant-based charge control agent may be present in a range from about 1 percent to about 10 percent by weight of the mixture, or about 1 percent to about 4 percent by weight of the emulsion polymerization mixture. In particular embodiments, CCA loading may be less than about 1 percent by weight of the polymerization reaction mixture. One skilled in the art will appreciate that the exact choice of CCA loading and total solids content may depend on the nature of the particular CCA selected.

The initial latex comprising polymer resin particles may have particles that range in size from about 100 nm to about 300 nm, or about 150 nm to 250 nm, or about 160 to about 240 nm.

Embodiments disclosed herein also provide processes comprising forming a latex by polymerizing under starve-fed emulsion polymerization conditions a mixture comprising a monomer emulsion comprising acrylate and styrene monomers in water and about 0.01 percent to about 4 percent by weight of the mixture of a metal salicylate, wherein the starve-fed emulsion polymerization conditions comprise a solids content in a range from about 10 to about 30 percent by weight of the mixture. Such latexes may be employed in the manufacture of toner particles, such as the core, shell, or both of toner particles.

Processes disclosed herein may comprise forming by emulsion aggregation/coalescence a plurality of toner particles. That is, the primary polymer resin particles in the latex derived by an emulsion polymerization may be formulated with conventional additives such as waxes, pigments, and subjected to aggregation with the aid of polyaluminum chloride. Such aggregation may be carried out with mixing and heating in a controlled manner to create aggregated particles with a well-defined narrow distribution of effective diameters. In some embodiments, the effective diameter may be in a range from about 2 to about 6 microns, or about 4 to about 6 microns, or about 5 microns. The aggregation may be performed with the CCA-doped latex as described herein, or with a latex lacking CCA doping. Where the core toner particle latex lacks CCA-doping, processes disclosed herein include providing a shell latex doped with CCA and coalescing the CCA-doped shell latex about the surface of the aggregated particles via heating.

Thus, processes disclosed herein may comprise forming a core of a toner particle from the latex doped with CCA. In other embodiments, processes disclosed herein may comprise forming a shell of a toner particle from the latex doped with CCA. In still further embodiments, processes disclosed herein may comprise forming a core and shell from the latex doped with CCA.

The resultant core-shell toner particle may have an effective diameter in a range of from about 3 microns to about 7 microns, or about 4 to about 6 microns, or about 5 microns. One skilled in the art will appreciate that the controlled emulsion aggregation/coalescence process allows the user to access toner particles larger or smaller than these recited ranges if so desired.

In embodiments, processes disclosed herein provide toner particles that support triboelectric charging sufficient for use not only under the demanding conditions of high humidity/high temperature of A-zone conditions, but also a sufficient charge for use under C-zone environmental conditions in a single-component development system. Thus, the toner particles disclosed herein can perform across the widest area of environmental conditions based on the A-zone and C-zone extremes.

In embodiments, the toner particle may be negatively charged. In some such embodiments, a sufficient triboelectric charge for use under A-zone environmental conditions is in a range from about −20 microcoulombs/gram to about −100 microcoulombs/gram, or from about −40 microcoulombs/gram to about −80 microcoulombs/gram, or from about −50 microcoulombs/gram to about −70 microcoulombs/gram. Such ranges of charge may be achieved employing non-surfactant-based charge control agent such as metal salicylates. In particular embodiments, metal salicylate may comprise zinc or aluminum ions. In embodiments, the non-surfactant-based charge control agent may be hydrophobic. Exemplary non-surfactant-based charge control agents that are hydrophobic are further exemplified herein below. In some embodiments, surfactant-based charge control agents may be employed in processes disclosed herein, however, their performance may depend on having a sufficiently low hygroscopicity. It was discovered that for operation under A-zone conditions, non-surfactant-based charge control agents bearing hydrophobic moieties can ameliorate the negative effects of elevated humidity and temperature. Moreover, it was also discovered that in processing, avoidance of reactor fouling can be dramatically affected by employing the non-surfactant-based charge control agents at concentrations lower than or equal to about 1% by weight of the toner particle.

In some embodiments, there are provided processes comprising polymerizing by emulsion polymerization a mixture comprising one or more monomers in an emulsion and about 10 percent or less by weight of the mixture of a non-surfactant-based charge control agent, wherein the polymerizing step provides a latex with the non-surfactant-based charge control agent distributed within a matrix of the latex, and the method further comprising forming by emulsion aggregation/coalescence a plurality of toner particles, wherein the plurality of toner particles support a sufficient triboelectric charge for use under A-zone environmental conditions in a single-component development system. Such processes may be used to form a core of a core-shell toner particle.

In some such embodiments, processes also provide the plurality of toner particles are also capable of supporting a sufficient charge for use under C-zone environmental conditions in a single-component development system.

In some embodiments, there are provided toner particles comprising a core-shell configuration, comprising a copolymer resin, less than about 10 percent by weight of the copolymer resin of zinc salicylate disposed uniformly within the matrix of the copolymer resin, a wax, and an optional colorant, wherein the toner particle supports a triboelectric charge in a range from about −45 to about −75 microcoulombs/gram under A-zone environmental conditions in a single-component development system. In some such embodiments, toner particles include a copolymer resin comprising a styrene-acrylate. In particular embodiments, the zinc salicylate is present in an amount of about 0.168% by weight of the toner particle. The toner copolymer resin may incorporate zinc salicylate charge control agent in the core, shell, or both. In principle, toner particles having these characteristics may be accessible by other processes known to those skilled in the art, such as dispersion or suspension polymerization.

Toner particles disclosed herein may be characterized by having distributed CCA throughout the matrix of the polymer resin particles of the latex at typical or lower than conventional loadings providing improved toner triboelectric charging performance.

The present disclosure provides toners and processes for the preparation of toner particles having excellent charging characteristics. Toners of the present disclosure may be prepared with a latex in which charge control agents (CCA) were incorporated during the latex polymerization process. The latex with CCA may then be used by itself, or combined with a non-CCA containing latex, pigment and wax, to form toner particles.

In embodiments, toners of the present disclosure may be prepared by combining a latex polymer having a charge control agent incorporated therein during the latex polymerization process, an optional colorant, an optional wax, and other optional additives. While the latex polymer may be prepared by any method within the purview of those skilled in the art, in embodiments the latex polymer may be prepared by emulsion polymerization methods, including semi-continuous emulsion polymerization and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resin

Processes disclosed herein for the manufacture of CCA-doped toner particles may employ one or more monomers comprising a styrene, an acrylate, a methacrylate, a butadiene, an isoprene, an acrylic acid, a methacrylic acid, an acrylonitrile, and combinations thereof. Any monomer suitable for preparing a latex for use in a toner may be utilized. As noted above, in embodiments the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex polymer may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like including their structural isomers. The aliphatic diol may be, for example, selected in an amount of from about 40 to about 60 mole percent, in embodiments from about 42 to about 55 mole percent, in embodiments from about 45 to about 53 mole percent, and a second diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, in embodiments from about 40 to about 60 mole percent, in embodiments from about 42 to about 52 mole percent, in embodiments from about 45 to about 50 mole percent, and a second diacid can be selected in an amount of from about 0 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate). Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly (octylene-adipimide), poly(ethylene-succinimide), poly(propylene-succinimide), and poly(butylene-succinimide).

The crystalline resin may be present, for example, in an amount of from about 1 to about 85 percent by weight of the toner components, in embodiments from about 5 to about 50 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diols selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly (propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

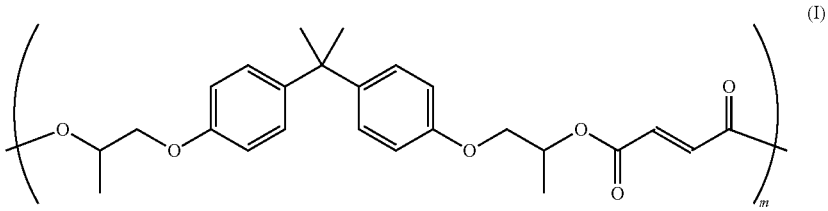

(I)

wherein m may be from about 5 to about 1000. Examples of such resins and processes for their production include those disclosed in U.S. Pat. No. 6,063,827, the disclosure of which is hereby incorporated by reference in its entirety. In addition, polyester resins which may be used include those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol.

In embodiments, a poly(styrene-butyl acrylate) may be utilized as the latex polymer. The glass transition temperature of this first latex, which in embodiments may be used to form a toner of the present disclosure, may be from about 35° C. to about 75° C., in embodiments from about 40° C. to about 70° C.

Surfactants

In embodiments, the latex may be prepared in an aqueous phase containing a surfactant or co-surfactant. Surfactants which may be utilized with the polymer to form a latex dispersion can be ionic or nonionic surfactants, or combinations thereof, in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL® and ALKAQUAT® available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments commercially available surfactants from Rhone-Poulenc such as IGEPAL® CA-210, IGEPAL® CA-520, IGEPAL® CA-720, IGEPAL® CO-890, IGEPAL® CO-720, IGEPAL® CO-290, IGEPAL® CA-210, ANTAROX® 890 and ANTAROX® 897 can be utilized.

The choice of particular surfactants or combinations thereof, as well as the amounts of each to be used, are within the purview of those skilled in the art.

Initiators

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including VAZO® peroxides, such as VAZO® 64, 2-methyl 2-2'-azobis propanenitrile, VAZO® 88, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methylpropionamidine] dihydrochloride, 2,2'-azobis[N-(4-amino-phenyl)-2-methylpropionamidine]tetrahydrochloride, 2,2'-azobis[2-methyl-N (phenylmethyl)propionamidine]dihydrochloride, 2,2'-azobis [2-methyl-N-2-propenylpropionamidine]dihydrochloride, 2,2'-azobis[N-(2-hydroxy-ethyl)2-methylpropionamidine] dihydrochloride, 2,2'-azobis[2(5-methyl-2-imidazolin-2-yl) propane]dihydrochloride, 2,2'-azobis[2-(2-imidazolin-2-yl) propane]dihydrochloride, 2,2'-azobis[2-(4,5,6,7-tetrahydro-1H-1,3-diazepin-2-yl)propane]dihydrochloride, 2,2'-azobis [2-(3,4,5,6-tetrahydropyrimidin-2-yl)propane] dihydrochloride, 2,2'-azobis[2-(5-hydroxy-3,4,5,6-tetrahydropyrimidin-2-yl)propane]dihydrochloride, 2,2'-azobis {2-[1-(2-hydroxyethyl)-2-imidazolin-2-yl] propane}dihydrochloride, combinations thereof, and the like.

Initiators can be added in suitable amounts, such as from about 0.1 to about 8 weight percent of the monomers, and in embodiments of from about 0.2 to about 5 weight percent of the monomers.

Chain Transfer Agents

In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the latex polymer when emulsion polymerization is conducted in accordance with the present disclosure.

Functional Monomers

In embodiments, it may be advantageous to include a functional monomer when forming the latex polymer and the particles making up the polymer. Suitable functional monomers include monomers having carboxylic acid functionality. Such monomers may be of the following formula (I):

(I)

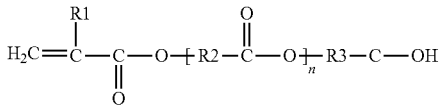

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such functional monomers include beta carboxyethyl acrylate (β-CEA), poly(2-carboxyethyl) acrylate, 2-carboxyethyl methacrylate, combinations thereof, and the like. Other functional monomers which may be utilized include, for example, acrylic acid, methacrylic acid and its derivatives, and combinations of the foregoing.

In embodiments, the functional monomer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the functional monomer having carboxylic acid functionality, in embodiments from about 0.5 to about 5 percent by weight of the functional monomer having carboxylic acid functionality.

Where present, the functional monomer may be added in amounts from about 0.01 to about 10 percent by weight of the total monomers, in embodiments from about 0.05 to about 5 percent by weight of the total monomers, and in embodiments about 3 percent by weight of total monomers.

Charge Control Agents

As noted above, in embodiments a charge control agent (CCA) may be added to the latex containing the polymer. The use of a CCA may be useful for triboelectric charging properties of a toner, because it may impact the imaging speed and quality of the resulting toner. However, poor CCA incorporation with toner binder resins or surface blending may result in unstable triboelectric charging and other related issues for toner. This poor incorporation may also be a problem for toners produced during an EA particle formation process when a CCA is added. For example, in some cases, where about 0.5% by weight of a CCA is added during an EA particle formation process, the actual amount of CCA remaining in the toner may be as low as about 0.15% by weight.

In contrast, the processes of the present disclosure may provide improved incorporation of a CCA into a toner compared with adding the CCA during an EA process in particulate form, as is done for conventionally processed, i.e., non-EA, toners. In accordance with the present disclosure, CCAs incorporated into a latex may be formed and then utilized to incorporate CCAs into a toner composition. The use of such CCAs incorporated into a latex may provide toners with excellent charging characteristics, with reduced loss of CCA from the toner particle during EA particle formation.

Suitable charge control agents which may be utilized include, in embodiments, metal complexes of alkyl derivatives of acids such as salicylic acid, other acids such as dicarboxylic acid derivatives, benzoic acid, oxynaphthoic acid, sulfonic acids, other complexes such as polyhydroxyalkanoate quaternary phosphonium trihalozincate, metal complexes of dimethyl sulfoxide, combinations thereof, and the like. Metals utilized in forming such complexes include, but are not limited to, zinc, manganese, iron, calcium, zirconium, aluminum, chromium, combinations thereof, and the like. Alkyl groups which may be utilized in forming derivatives of salicylic acid include, but are not limited to, methyl, butyl, t-butyl, propyl, hexyl, combinations thereof and the like. Examples of such charge control agents include those commercially available as BONTRON® E-84 and BONTRON® E-88 (commercially available from Orient Chemical). BONTRON® E-84 is a zinc complex of 3,5-di-tert-butylsalicylic acid in powder form. BONTRON® E-88 is a mixture of hydroxyaluminium-bis[2-hydroxy-3,5-di-tert-butylbenzoate] and 3,5-di-tert-butylsalicylic acid. Other CCA's suitable for copolymerization with monomers are the calcium complex of 3,5-di-tert-butylsalicylic acid, a zirconium complex of 3,5-di-tert-butylsalicylic acid, and an aluminum complex of 3,5-di-tert-butylsalicylic acid, as disclosed in U.S. Pat. Nos. 5,223,368 and 5,324,613, the disclosures of each of which are incorporated by reference in their entirety, combinations thereof, and the like.

In embodiments, as noted above, a charge control agent may be in an aqueous dispersion or a CCA incorporated into a latex. In embodiments, the charge control agent may be dissolved into monomer(s) making up a latex emulsion to form a mixture, which may then be polymerized to incorporate the charge control agent into the copolymer. Polymerizing the mixture may occur by a process such as emulsion polymerization, suspension polymerization, dispersion polymerization, and combinations thereof.

In embodiments, a functional monomer may be utilized to form such a latex possessing a charge control agent. Suitable functional monomers, in embodiments, include those described above having carboxylic acid functionality. For example, in embodiments, a functional monomer having carboxylic acid functionality, such as acrylic acid, methacrylic acid, β-CEA, poly(2-carboxyethyl) acrylate, 2-carboxyethyl methacrylate, combinations thereof, and the like, may be combined with the charge control agent to form a CCA emulsion. Where present, a functional monomer may be present in an amount of from about 0.01 percent by weight to about 10 percent by weight of the monomers, in embodiments from about 0.5 percent by weight to about 4 percent by weight of the monomers used to form the latex. In embodiments, the charge control agent may thus be present in an amount of from about 0.01 percent by weight to about 10 percent by weight of the monomers, in embodiments from about 0.01 percent by weight to about 5 percent by weight of the monomers used to form the latex.

In embodiments, a CCA incorporated into a latex may also include a surfactant. Any surfactant described above may be utilized to form the latex. Where utilized, a surfactant may be present in an amount of from about 0.25 percent by weight to about 20 percent by weight of the latex, in embodiments from about 0.5 percent by weight to about 4 percent by weight of the latex.

Conditions for forming the CCA incorporated into a latex are within the purview of those skilled in the art. In embodiments, the CCA incorporated into a latex may be formed by combining the CCA, functional monomer, other monomers, chain transfer agents, and optional surfactant in a suitable container, such as a mixing vessel. The appropriate amount of CCA, stabilizer, surfactant(s), if any, and the like may be then combined in the reactor which contains an appropriate amount of water and surfactant, followed by an addition of an appropriate amount of initiator to commence the process of latex polymerization to produce latex particles containing the CCA.

Reaction conditions selected for forming the latex with incorporated CCA include temperatures of, for example, from about 30° C. to about 90° C., in embodiments from about 40° C. to about 85° C. Mixing may occur at a rate of from about 40 revolutions per minute (rpm) to about 450 rpm, in embodiments from about 50 rpm to about 300 rpm. The reaction may continue until the latex with incorporated CCA has formed, which may take from about 200 minutes to about 660 minutes, in other embodiments from about 240 minutes to about 600 minutes, or until monomer conversion is complete to obtain low acceptable residual volatiles.

The particle size of the CCA and/or CCA copolymer in the emulsion thus produced may be from about 15 nm to about 500 nm, in embodiments from about 20 nm to about to 300 nm, in embodiments from about 30 nm to about to 250 nm, in some embodiments about 37 nm, and in some embodiments about 215 nm. The particles thus produced are negatively charged and may be used alone as a charge control agent for a toner.

Contrary to methods which may utilize particulate CCAs, optionally in dispersions, and combine same with toner particles, the present disclosure forms a CCA which is incorporated in the polymer of a latex resin utilized to form a toner particle.

Thus, in accordance with the present disclosure, the latex possessing a CCA incorporated into the latex particle provides an alternative way to incorporate a CCA such as 3,5 Di-tert-butylsalicylic acid, zinc salt into a toner formed by an emulsion aggregation process.

For example, in embodiments, a resin utilized to form toner particles may include a first component derived from at least one metal complex of an alkyl derivative of an acid, at least a second component derived from a monomer utilized to form a resin, and optionally a component derived from at least one functional monomer possessing carboxylic acid functionality. For example, in embodiments, toner particles may be formed from a resin including a copolymer of the present disclosure, which may include beta carboxyethyl acrylate and a zinc salt of 3,5-di-tert-butylsalicylic acid, as well as monomers for the resin described above, for example styrene, butyl acrylate, combinations thereof, and the like.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Wax

Wax dispersions may also be added during formation of a latex polymer in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE® N-15 commercially available from Eastman Chemical Products, Inc., Viscol 550-P, a low weight average molecular weight polypropylene available from Sanyo Kasel K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL® 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in an amount of from about 0.1 to about 30 percent by weight, and in embodiments from about 2 to about 20 percent by weight of the toner.

Colorants

The latex particles may be added to a colorant dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. In embodiments, the surfactant may be ionic and may be from about 1 to about 25 percent by weight, and in embodiments from about 4 to about 15 percent by weight, of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or combinations thereof. In embodiments a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including Rhodamine B type, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including M08029™, M08060™; Columbian magnetites; MAPICO BLACKS™ and surface treated magnetites; Pfizer magnetites including CB4799™ CB5300™, CB5600™, MCX6369™; Bayer magnetites including, BAYFERROX® 8600, 8610; Northern Pigments magnetites including, NP-604™, NP-608™; Magnox magnetites including TMB-100™, or TMB-104™, HELIOGEN BLUE L6900™, D6840™ D7080™, D7020™, PYLAM® OIL BLUE, PYLAM® OIL YELLOW, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM® PINK E from Hoechst; and CINQUASIA® MAGENTA available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as FORON® Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant. Pigment Red 122 (sometimes referred to herein as PR-122) has been widely used in the pigmentation of toners, plastics, ink, and coatings, due to its unique magenta shade.

Reaction Conditions

In the emulsion aggregation process, the reactants may be added to a suitable reactor, such as a mixing vessel. A blend of latex, optional colorant dispersion, wax, and aggregating agent, may then be stirred and heated to a temperature near the Tg of the latex, in embodiments from about 30° C. to about 70° C., in embodiments from about 40° C. to about 65° C., resulting in toner aggregates of from about 3 microns to about 15 microns in volume average diameter, in embodiments of from about 5 microns to about 9 microns in volume average diameter.

In embodiments, a shell may be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C. In embodiments, a shell may be formed on the aggregated particles including a blend of a first latex for the core and a latex incorporated with a CCA.

Where present, a shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns. In other embodiments, the toner particles may be prepared by in-situ seeded semi-continuous emulsion copolymerization of the latex with the addition of the shell latex once aggregated particles have formed.

Coagulants

In embodiments, a coagulant may be added during or prior to aggregating the latex and the aqueous colorant dispersion. The coagulant may be added over a period of time from about 1 minute to about 60 minutes, in embodiments from about 1.25 minutes to about 20 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in embodiments from about 0.1 to about 3 percent by weight of the toner.

Aggregating Agents

Any aggregating agent capable of causing complexation might be used in forming toner of the present disclosure. Both alkali earth metal or transition metal salts can be utilized as aggregating agents. In embodiments, alkali (II) salts can be selected to aggregate sodium sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

The resulting blend of latex, optionally in a dispersion, CCA, optionally in dispersion, optional colorant dispersion, optional wax, optional coagulant, and optional aggregating agent, may then be stirred and heated to a temperature below the Tg of the latex, in embodiments from about 30° C. to about 70° C., in embodiments of from about 40° C. to about 65° C., for a period of time from about 0.2 hours to about 6 hours, in embodiments from about 0.3 hours to about 5 hours, resulting in toner aggregates of from about 3 microns to about 15 microns in volume average diameter, in embodiments of from about 4 microns to about 8 microns in volume average diameter.

Once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The mixture of latex, latex incorporated with a CCA, optional colorant, and optional wax may be subsequently coalesced. Coalescing may include stirring and heating at a temperature of from about 80° C. to about 99° C., in embodiments from about 85° C. to about 98° C., for a period of from about 0.5 hours to about 12 hours, and in embodiments from about 1 hour to about 6 hours. Coalescing may be accelerated by additional stirring.

The pH of the mixture may then be lowered to from about 3.5 to about 6, in embodiments from about 3.7 to about 5.5, with, for example, an acid to coalesce the toner aggregates. Suitable acids include, for example, nitric acid, sulfuric acid, hydrochloric acid, citric acid or acetic acid. The amount of acid added may be from about 0.1 to about 30 percent by weight of the mixture, and in embodiments from about 1 to about 20 percent by weight of the mixture.

The mixture is cooled in a cooling or freezing step. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling medium such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may be implemented by the introduction of a heat exchanger when the final toner slurry is discharged.

The toner slurry may then be washed. Washing may be carried out at a pH of from about 7 to about 12, and in embodiments at a pH of from about 9 to about 11. The washing may be at a temperature of from about 30° C. to about 70° C., and in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

Toner particles may possess a CCA, in embodiments a CCA incorporated into a latex, in amounts of from about 0.01 percent by weight to about 10 percent by weight of the toner particles, in embodiments from about 0.1 percent by weight to about 8 percent by weight of the toner particles. As noted above, the toner particles may possess CCA latex in the core, shell, or a combination of both. When in a combination of core and shell, the ratio of CCA latex in the core to the shell may be from about 1:99 to about 99:1, and all combinations in between. In embodiments, toners of the present disclosure possessing a CCA that has been added during the EA process as a dispersion may have a triboelectric charge of from about −2 μC/g to about −60 μC/g, in embodiments from about −10 μC/g to about −40 μC/g. Toners of the present disclosure may also possess a parent toner charge per mass ratio (Q/M) of from about −3 μC/g to about −35 μC/g, and a final toner charging after surface additive blending of from −10 μC/g to about −45 μC/g.

Additives

Further optional additives which may be combined with a toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL® R972 available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.9 to about 0.99, in embodiments from about 0.92 to about 0.98.

Following the methods of the present disclosure, toner particles may be obtained having several advantages compared with conventional toners: (1) increase in the robustness of the particles' triboelectric charging, which reduces toner defects and improves machine performance; (2) easy to implement, no major changes to existing aggregation/coalescence processes; and (3) increase in productivity and reduction in unit manufacturing cost (UMC) by reducing the production time and the need for rework (quality yield improvement).

Uses

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Imaging

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

This series of Examples describes processes for the incorporation of CCA into a styrene/acrylate latex with minimal reactor fouling and low generation of course particles in the latex.

Comparative Example

This Comparative Example describes the preparation of a latex without charge control agent by emulsion polymerization. Control latex with 5% seed and emulsified monomer red, no charge control agent.

A monomer phase was prepared by combining 441.2 g of styrene (Shell Chemicals Canada Ltd (Fort Saskatchewan, Alberta, Canada)), 98.8 g of n-butyl acrylate (Dow Chemical Co. (Midland, Mich., USA)), 16.2 g of beta-carboxyethylacrylate (β-CEA) in a 1 L beaker. To this mixture was added 1.89 g of a branching agent 1,10-Decanediol diacrylate (ADOD) and 3.83 g of a chain transfer agent dodecanethiol (DDT). In a separate beaker, 9.18 g of DOWFAX® surfactant was added to 257 g of de-ionized water (DIW). The monomer phase was added to the surfactant solution and mixed to prepare a monomer emulsion. The mixture was transferred into a 1 L glass kettle with nitrogen purge. 474 g of DIW was added to a 2 L Buchi reactor with 2.31 g DOWFAX® surfactant. The reactor was then continuously purged with nitrogen while being stirred at 300 RPM, and heated to 75 C. 41.6 g of the monomer emulsion was then pumped into the reactor to form the "seeds". 8.1 g of ammonium persulfate (APS) initiator were added to 80 g of DIW and the mixture was stirred until the APS was completely dissolved. The APS solution was then pumped into the reactor at a rate of 2.2 g/min. After sixty minutes from the start of the APS feed, the monomer emulsion was pumped into the reactor at a rate of 3.3 g/min. When half the emulsion had been pumped in, the monomer feed was suspended and 3.92 g of DDT were added to the emulsion and stirred in. After 10 minutes, the reactor mixing speed was set to 350 rpm. Subsequently the monomer feed was resumed at 4.4 g/min until all of the emulsion had been added. The resultant latex was held at 75° C. for a further 3 hours to complete the reaction after the end of the monomer feed. Full cooling was then applied and the reactor temperature was reduced to 35 C. The produced latex was discharged and the reactor was dismantled. No fouling was observed on the reactor wall, impellers, and baffle (the percentage of fouling was less than 1%). The resultant latex had a particle size of 191.4 nm, $T_g$(onset) of 60.4° C., and solid content of 41.5%.

Example 1

This Example describes the preparation of a latex with a zinc salicylate charge control agent. The Example employs a 158 minute neat monomer feed.

A monomer phase was prepared by combining 435.8 g of styrene (St), 104.2 g of n-butyl acrylate (BA), 16.2 g of beta-carboxyethylacrylate (β-CEA) in a 1 L glass kettle with nitrogen purge. To this mixture was added 7.47 g of a chain transfer agent dodecanethiol (DDT). The monomer phase was mixed and 11.7 g of the mixture was weighed out in a separate beaker as "seed" monomer. 21.6 g of the charge control agent BONTRON® E-84 (Orient Chemical Industries Ltd (Seaford, Del.)) was added to the mixture in 1 L glass kettle while being stirred at 300 RPM for 1 hour. 728 g of DIW was added to a 2 L Buchi reactor with 1.96 g DOWFAX® surfactant. The reactor was then continuously purged with nitrogen while being stirred at 300 RPM, and heated to 75 C. 11.7 g of pre-weighted "seed" monomers was then added into the reactor. 10.8 g of ammonium persulfate (APS) initiator were added to 40.7 g of DIW and the mixture was stirred until the APS was completely dissolved. The APS solution was then pumped into the reactor at a rate of 2.6 g/min. After forty minutes from the start of the APS feed, the monomer phase was pumped into the reactor at a rate of 3.63 g/min. Once the monomer feed was started, 1.4 g of DOWFAX® surfactant was manually added to the reactor every 13 minutes to a maximum of 13.99 g. When half the monomer mixture had been pumped in, the reactor mixing speed was set to 350 rpm. After all of the monomer was fed in, the resultant latex was held at 75° C. for 1 hour, and then increased to 90° C. for another 2 hours to complete the reaction. Full cooling was then applied and the reactor temperature was reduced to 35° C. The produced latex was discharged and the reactor was dismantled. The significant fouling was observed on the reactor wall, impellers, and baffle. The percentage of fouling was calculated approximately 71% by weight. The resultant latex had a particle size of 162.7 nm and Tg(onset) of 61.87° C.

Example 2

This Example describes the preparation of a latex with a zinc salicylate charge control agent. In this Example, surfactant was pumped into the reactor before monomer feed initiated.

A monomer phase was prepared by combining 435.8 g of styrene (St), 104.2 g of n-butyl acrylate (BA), 16.2 g of beta-carboxyethylacrylate (β-CEA) in a 1 L glass kettle with nitrogen purge. To this mixture was added 7.47 g of a chain transfer agent dodecanethiol (DDT). The monomer phase was mixed and 30.0 g of the mixture was weighed out in a separate beaker as "seed" monomer. 21.6 g of the charge control agent BONTRON® E-84 was added to the mixture in 1 L glass kettle while being stirred at 300 RPM for 1 hour. 576 g of DIW was added to a 2 L Buchi reactor with 1.96 g DOWFAX® surfactant. The reactor was then continuously purged with nitrogen while being agitated at 300 RPM, and heated to 75 C. 30.0 g of pre-weighted "seed" monomers was then added into the reactor. 10.8 g of ammonium persulfate (APS) initiator were added to 40.7 g of DIW and the mixture was stirred until the APS was completely dissolved. The APS solution was then pumped into the reactor at a rate of 2.6 g/min. In a separate beaker, a surfactant solution consisting of 13.99 g of DOWFAX® surfactant and 116 g of de-ionized water (DIW) was prepared. After fifty minutes from the start of the APS feed, the prepared surfactant solution was added to the reactor in 14 minutes. After 10 minutes holding time, the monomer mixture was pumped into the reactor at a rate of 2.82 g/min. When half the monomer had been pumped in, the monomer feed rate was increased to 3.8 g/min and the reactor mixing speed was set to 350 rpm. After all of the monomer phase was fed in, the resultant latex was held at 75° C. for 1 hour, and then increased to 90° C. for another 2 hours to complete the reaction. Full cooling was then applied and the reactor temperature was reduced to 35° C. The produced latex was discharged and the reactor was dismantled. The significant fouling was observed on the reactor wall, impellers, and baffle. The percentage of fouling was calculated approximately 50% by weight. The resultant latex had a particle size of 193.7 nm and $T_g$(onset) of 59.26° C.

Example 3

This Example describes the preparation of a latex with a zinc salicylate charge control agent. In this Example, surfactant was co-emulsified with monomer.

The formulation and procedure were identical to Example 1 except that 13.99 g of DOWFAX® surfactant was added to the monomer phase in 1 L glass kettle after 11.7 g of seed monomer was weighed out, instead of manual addition of the DOW FAX surfactant to the reactor. The monomer phase was pumped into the reactor at a rate of 3.72 g/min instead of 3.63 g/min. No latex emulsion was obtained at the end of the reaction. The whole batch turned to "glue" material.

Example 4

This Example describes the preparation of a latex with a zinc salicylate charge control agent. In this Example, there was a longer monomer feed time of about 260 minutes.

The formulation and procedure were identical to Example 1 except that the monomer phase was pumped into the reactor at a rate of 2.21 g/min instead of 3.63 g/min. 1.4 g of DOWFAX® was manually added to the reactor every 25 minutes to a maximum of 13.99 g. The resultant latex had a particle size of 180.4 nm and $T_g$(onset) of 35.4° C. The percentage of fouling was calculated around 60% by weight.

Example 5

This Example describes the preparation of a latex with a zinc salicylate charge control agent. In this Example, 20% more surfactant was added.

The formulation and procedure were identical to Example 1 except that 1.68 g of DOWFAX® surfactant was manually added to the reactor every 13 minutes to a maximum of 16.78 g instead of 13.99 g. The percentage of fouling was calculated approximately 24% by weight. The resultant latex had a particle size of 160.2 nm and $T_g$(onset) of 58.2° C.

Example 6

This Example describes the preparation of a latex with a zinc salicylate charge control agent. In this Example, there was a dual feed with TAYCA® surfactant.

The formulation and procedure were identical to Example 1 except that TAYCA® surfactant (60% active) was used in the formulation instead of DOWFAX® surfactant. 484 g of DIW was added to 2 L Buchi reactor with 1.54 g of TAYCA® surfactant instead of 728 g of DIW and 1.96 g of DOWFAX® used in Example 1. 10.96 g of TAYCA® surfactant was diluted with 244 g of DIW that was split from a total of 728 g. This solution was pumped into the reactor at a rate of 1.61 g/min after forty minutes from the start of the APS feed. No latex emulsion was produced at the end of the reaction. The whole batch turned to "solid" fouling material.

Example 7

This Example describes the preparation of a latex with a zinc salicylate charge control agent. In this Example, solids content (content) was reduced to 30%.

Procedure was identical to Example 1 except that the solid content in the formulation was decreased to 30% instead of 43.7% that was used in Example 1. The resultant latex had a particle size of 200.7 nm and $T_g$(onset) of 54.7° C. The percentage of fouling was calculated approximately 8% by weight.

Example 8

This Example describes the preparation of a latex with a zinc salicylate charge control agent. In this Example, solids content (content) was reduced to 25%.

Procedure was identical to Example 1 except that the solid content in the formulation was decreased to 25% instead of 43.7% that was used in EXAMPLE 1. The resultant latex had a particle size of 166.7 nm and $T_g$(onset) of 56.7° C. The percentage of fouling was calculated less than 2% by weight.

In general, stable particles in a useful size range of from about 160 to about 240 nm with minimal settling of coarse particles were accessible by the methods describe above. The Examples above provide a variety of approaches to reduce reactor fouling including emulsifying the monomer and CCA material into the surfactant solution, adding more surfactant to increase stability, adding the surfactant to the monomer mixture without water, changing the surfactant from DOWFAX® to TAYCA®, and lengthening the time required to feed in the monomer. None of these approaches improved the stability and scalability of the latex and in some cases fouling was dominant. Only when the solids content of the organic materials was reduced to 30 wt. % (EXAMPLE 7) from 43.7 wt. % (EXAMPLES 1-6) was the amount of fouling reduced from about 50-99% down to about 8%. Upon reducing the solids content further to 25% (EXAMPLE 8) the resulting latex had less than about 2 wt. % of fouled material. The result in EXAMPLE 8 was close to the control latex of the Comparative Example which produced less than about 1 wt. % of fouled material. As summarized in Table 1 below, many approaches generated very high levels of coarse particles or fouled material.

TABLE 1

| Example | Solids Content (wt. %) | Quantification of Fouling |
|---|---|---|
| 1 | 43.7 | 71% |
| 2 | 43.7 | 50% |
| 3 | 43.7 | 99% |
| 4 | 43.7 | 60% |
| 5 | 43.7 | 24% |
| 6 | 43.7 | 99% |
| 7 | 30.0 | 8% |
| 8 | 25.0 | <2% |
| Comparative Example | 41.5 | <1% |

Table 2 below summarizes the latex properties of EXAMPLES 1-8 and the Comparative Example lacking charge control agent.

TABLE 2

| Example | $T_g$ (° C., onset) | Particle Size (nm) | Zn (ppm) |
|---|---|---|---|
| 1 | 61.9 | 162.7 | 3562 |
| 2 | 59.3 | 193.7 | 3501 |
| 3 | N/A | N/A | N/A |
| 4 | 35.4 | 180.4 | 4683 |
| 5 | 58.2 | 160.2 | 2989 |
| 6 | N/A | N/A | N/A |
| 7 | 54.7 | 200.7 | 2997 |
| 8 | 56.7 | 166.7 | 3798 |
| Comparative Example | 60.4 | 191.4 | N/A |

The latex properties for EXAMPLE 7 (30% solids content) and EXAMPLE 8 (25% solids content) had desirable thermal properties with $T_g$(onset)=54-56° C. and particle size in the 160-200 nm range.

What is claimed is:

1. A process comprising:

forming, by emulsion polymerization, polymer resin particles in a latex, the polymer resin particles being formed from a mixture comprising:

one or more monomer emulsions; and a non-surfactant-based charge control agent;

wherein the emulsion polymerization is carried out under starved-fed conditions with a solids content in a range from about 10 to about 30 percent by weight of the mixture; and forming toner particles from the polymer resin particles, wherein the toner particles are formed by emulsion aggregation/coalescence and wherein the toner particles support a sufficient triboelectric charge for use under A-zone environmental conditions in a single-component development system.

2. The process of claim 1, wherein the step of forming the polymer resin particles generates less than about 10 percent reactor fouling.

3. The process of claim 1, wherein polymer resin particles range in size from about 150 nm to 250 nm.

4. The process of claim 1, wherein the non-surfactant-based charge control agent is present in a range from about 1 percent to about 10 percent by weight of the mixture.

5. The process of claim 1, wherein the non-surfactant-based charge control agent is present in an amount less than or equal to about 4 percent by weight of the mixture.

6. The process of claim 1, wherein the toner particles support a sufficient triboelectric charge for use under C-zone environmental conditions in a single-component development system.

7. The process of claim 1, wherein the toner particle is negatively charged.

8. The process of claim 1, wherein the sufficient triboelectric charge for use under A-zone environmental conditions is in a range from −20 microcoulombs/gram to about −100 microcoulombs/gram.

9. The process of claim 1, wherein the non-surfactant-based charge control agent is a metal salicylate.

10. The process of claim 9, wherein the metal salicylate comprises zinc or aluminum.

11. The process of claim 1, wherein the non-surfactant-based charge control agent is hydrophobic.

12. The process of claim 1, wherein the latex is incorporated in a core of the toner particles comprising forming a core of a toner particle from the latex.

13. The process of claim 1, wherein the latex is incorporated in a shell of the toner particles comprising forming a shell of a toner particle from the latex.

14. The process of claim 1, wherein the latex is incorporated in a shell and a core of the toner particles comprising forming a core and shell from the latex.

15. The process of claim 1, wherein the one or more monomers comprises a monomer selected from the group consisting of a styrene, an acrylate, a methacrylate, a butadiene, an isoprene, an acrylic acid, a methacrylic acid, an acrylonitrile, and combinations thereof.

16. A process comprising:

forming, by emulsion polymerization under starved-fed conditions, a latex from a mixture comprising:

a monomer emulsion comprising acrylate and styrene monomers in water; and about 0.1 percent to about 10 percent by weight of the mixture of a metal salicylate;

wherein the solids content of the mixture is in a range from about 10 to about 30 percent by weight of the mixture; and forming toner particles from the latex, wherein a shell portion of the toner particles comprises the latex.

17. The process of claim 16, wherein a core portion of the toner particles comprises the latex.

* * * * *